US009532634B2

(12) United States Patent
Lee et al.

(10) Patent No.: US 9,532,634 B2
(45) Date of Patent: Jan. 3, 2017

(54) NAIL POLISH BOTTLE

(71) Applicant: Pro-Vision International, Inc., Whitestone, NY (US)

(72) Inventors: Young Hoon Lee, Whitestone, NY (US); Cheon Sook Lee, Bucheon (KR)

(73) Assignee: PRO-VISION INTERNATIONAL, INC., Whitestone, NY (US)

( * ) Notice: Subject to any disclaimer, the term of this patent is extended or adjusted under 35 U.S.C. 154(b) by 259 days.

(21) Appl. No.: 14/315,347

(22) Filed: Jun. 26, 2014

(65) Prior Publication Data

US 2015/0110542 A1 Apr. 23, 2015
US 2016/0295991 A9 Oct. 13, 2016

(30) Foreign Application Priority Data

Apr. 3, 2013 (KR) ..... 2013-0036282

(51) Int. Cl.
*A45D 34/04* (2006.01)

(52) U.S. Cl.
CPC ..... *A45D 34/042* (2013.01)

(58) Field of Classification Search
CPC combination set(s) only.
See application file for complete search history.

(56) References Cited

U.S. PATENT DOCUMENTS 4,513,891 A * 4/1985 Hain ..... A61M 15/08 222/213
5,472,122 A * 12/1995 Appleby ..... B65D 47/2031 222/212
6,505,986 B1 * 1/2003 Oder ..... A45D 19/02 222/211

* cited by examiner

*Primary Examiner* — David Walczak
(74) *Attorney, Agent, or Firm* — Mark M. Friedman

(57) ABSTRACT

A nail polish bottle comprises a bottle body, a cap including a disc portion having a center hole and one or more air holes and including a discharge passage and one or more external-air introduction grooves in flow contact with the air holes. A pressure opening and closing valve is mounted to the disc portion such that a skirt portion of the valve may sit below the disc portion and a top of the valve may be above the disc portion. The skirt portion may press against the disc portion to close the air holes. When internal pressure in the bottle body opens the top of the valve, nail polish may flow through the discharge passage if the bottle is upside-down. When the internal pressure is released, the top of the valve may close and the skirt portion may move away from the disc to open the air holes.

5 Claims, 10 Drawing Sheets

NAIL POLISH BOTTLE

PRIORITY CLAIM

The present nonprovisional U.S. patent application claims priority to and benefit from pending Korean patent application no. 10-2013-0124649 filed Oct. 18, 2013.

FIELD AND BACKGROUND OF THE INVENTION

The present invention relates, in general, to a nail polish bottle intended to contain nail polish liquid therein, and, more particularly, to a nail polish bottle having a pressure opening and closing valve.

DESCRIPTION OF THE RELATED ART

Korean Patent Laid-Open Publication No. 10-2002-0021579 (published on Mar. 21, 2002) disclosed an "Automatic Nail Polish Bottle". The automatic nail polish bottle includes a cap, a body, a tube, a covering member, a brush support plate, a brush, a button, and a spring. Internal threads are formed in the cap. External threads are formed on the body to allow the body to be fastened to the cap. The tube is provided in the body to contain nail polish liquid therein. The covering member is movably provided on an upper portion of the body to cover the tube. The brush support plate is screwed to an inlet of the tube and has a hole to permit the passage of the nail polish liquid. The brush is provided on the brush support plate. The button is provided on an outer surface of the body to press the tube. The spring is provided at a predetermined position on an inner surface of the body to restore the button to its original state.

However, the automatic nail polish bottle is problematic in that, when one desires to use the bottle, the covering member should be pushed in an opening direction, and, after the bottle has been used, a user should push the covering member in a closing direction, so that it is inconvenient to use, and, unless the covering member is closed after the use, the nail polish liquid may unexpectedly leak from the body.

The foregoing is intended merely to aid in the understanding of the background of the present invention, and is not intended to mean that the present invention falls within the purview of the related art that is already known to those skilled in the art.

There is a compelling need for a nail polish bottle that prevents leakage of the nail polish and is convenient to use and overcomes the drawbacks of the prior art.

SUMMARY OF THE INVENTION

One aspect of the present invention is a nail polish bottle, comprising a bottle body; a cap including a disc portion having a center hole and a plurality of air holes formed in the disc portion, the cap having a discharge passage disposed above the center hole and external-air introduction grooves in flow contact with the air holes of the disc portion; and a pressure opening and closing valve mounted to the disc portion such that a skirt portion of the valve sits below the disc portion and such that a top of the valve is above the disc portion, when internal pressure in the bottle body is increased by squeezing the bottle, the skirt portion presses against the disc portion to close the air holes and the top of the valve opens allowing nail polish to flow through the discharge passage if the bottle is upside-down, and when the internal pressure is restored by releasing a squeezing force, the skirt portion moves away from the disc to open the air holes and the top of the valve closes to block polish from escaping through the discharge passage.

The bottle may further include a structure wherein the top of the valve comprises a pair of pieces that either contact each other to close or else move away from each other to open, depending upon the internal pressure of the bottle body. The pieces may be rectangular pieces. The pair of pieces may contact each other to keep an upper end of a hollow portion of the valve closed until pressure is exerted through the hollow portion. The upper end of the hollow portion of the valve may be above the center hole of the disc portion. The hollow portion of the valve may be inward of a cylindrical portion of the valve. The external air-introduction grooves may have a small enough clearance such that a viscous nail polish in the bottle does not leak out of the bottle through the air holes and grooves even when the bottle is upside down before the bottle is squeezed. It may be the case that when internal pressure in the bottle body is increased by squeezing the bottle, the skirt portion may press against the disc portion as a result of radially distal ends of the skirt portion flex toward the disc portion.

A further aspect of the present invention may comprise a nail polish bottle, comprising a bottle body; a cylindrical cap fastened to the bottle body, and including a disc portion in the cap, with a center hole and a plurality of air holes formed in the disc portion; a pressure opening and closing valve mounted to the disc portion, a top of the valve above the center hole opening or closing depending on internal pressure of the bottle body, the valve also opening or closing the air holes of the disc portion depending on internal pressure of the bottle body; an inner cap member mounted to the cap, with a discharge passage disposed above the center hole; and an outer cap member mounted to the cap, with at least one external-air introduction groove that is formed on the outer cap member and that is in flow contact with at least one air hole of the disc portion.

This aspect of the present invention may also be structured so that upon squeezing the bottle body when the bottle is upside-down, a skirt portion of the valve presses again a lower surface of the disc portion so as to block the air holes of the disc portion, while internal pressure forces a gap between pieces of a top of the valve, thereby allowing nail polish to flow through the gap out of the bottle. In some versions, the pieces of the top of the valve comprise a pair of rectangular pieces that may be integrally joined to a top of a cylindrical portion of the valve. In some versions, the rectangular pieces may come into contact with each other to keep an upper end of a hollow portion defined by the cylindrical portion of the valve closed, and, if pressure is exerted through the hollow portion, the rectangular pieces may move away from each other. In certain versions, restoring internal pressure in the bottle as before the bottle was squeezed may close the gap so as to block further flow of nail polish out of the bottle through said gap and may restore the skirt portion to a position away from the disc portion thereby allowing external-air to enter the bottle body through the at least one external-air introduction groove. In some versions, an enlarged groove is formed in the inner cap member and wherein the inner cap member is covered by the outer cap member, the outer cap member coming into contact with an inner circumference of an upper end of the cap.

There may be versions structured such that the cylindrical cap is fastened to a bottleneck portion of the bottle body, and wherein a helical fastening portion is formed on the bottleneck portion.

The cap may comprise an upper cylindrical portion and a lower cylindrical portion, the upper cylindrical portion integrally formed on an upper end of the lower cylindrical portion in a stepped configuration.

In some versions, a helical fastening portion is formed on an inner circumference of the lower cylindrical portion, a stopper protrusion is formed above the helical fastening portion, and the disc portion is formed above the stopper protrusion. In some versions, a locking protrusion is formed on an upper end of an inner circumference of the upper cylindrical portion.

A skirt portion of the valve may be provided on a lower end of a cylindrical portion. The skirt portion may flex toward the air holes and may block the air holes of the disc portion when internal pressure is increased in the bottle body.

In some versions, a pair of rectangular pieces is integrally provided on a top of the cylindrical portion, the rectangular pieces coming into contact with each other to keep an upper end of the hollow portion closed unless increased internal pressure from the bottle body is exerted through the hollow portion.

In some versions of the present invention, the inner cap member comprises a body having a truncated cone shape, and a cylindrical portion is integrally formed on an upper end of the body in such a way as to extend upwards therefrom, and an enlarged groove is defined in the body, and a discharge passage extends from an upper end of the enlarged groove in such a way as to pass through the cylindrical portion, and a pocket is formed in an upper portion of the body so as to accommodate a brush therein, and the cylindrical portion is disposed in the brush, with the discharge passage defined in the cylindrical portion.

In some versions, the outer cap member comprises a cylindrical portion, with an elliptical hollow portion formed in the cylindrical portion, and an extended inclined portion is integrally formed on a lower end of the cylindrical portion, and an enlarged cylindrical portion is provided on a lower end of the extended inclined portion, and an enlarged inclined hole is formed in a lower end of the hollow portion corresponding to the extended inclined portion in such a way as to extend downwards therefrom, and an inner inclined surface is formed around the enlarged inclined hole, and a plurality of external-air introduction grooves is formed on the extended inclined portion and an outer circumference of the enlarged cylindrical portion.

The present invention is intended to propose a nail polish bottle, in which a pressure opening and closing valve is mounted to an outlet of a bottle body, so that, if a bottle body made of flexible material, such as a synthetic resin material, is pushed, the internal pressure of the bottle body is increased and thus the pressure opening and closing valve is opened, thereby discharging nail polish liquid from an interior of the bottle body to a brush and, if force is eliminated from the bottle body, the internal pressure of the bottle body is restored to its original state and thus the pressure opening and closing valve is closed, thereby automatically preventing the nail polish liquid from leaking.

In a further aspect of the present invention, there is provided a nail polish bottle, including a bottle body; a cylindrical cap fastened to a bottleneck portion of the bottle body, and including a disc portion in the cap, with a center hole and a plurality of air holes formed in the disc portion; a pressure opening and closing valve mounted to the disc portion, the pressure opening and closing valve opening or closing the center hole and the air hole of the disc portion; an inner cap member mounted to the cap, with a discharge passage and an enlarged groove formed in the inner cap member; and an outer cap member mounted to the cap, with a plurality of external-air introduction grooves formed on the outer cap member, whereby the inner cap member is covered by the outer cap member that comes into contact with an inner circumference of an upper end of the cap, and the enlarged groove of the inner cap member coupled to the discharge passage is disposed above the center hole of the disc portion.

The bottle body may be made of a flexible nylon material by injection molding, and a side portion of the bottle body may be compressed by external force and then may be restored to its original state, with a helical fastening portion formed on the bottleneck portion.

The cap may include an upper cylindrical portion and a lower cylindrical portion, with the upper cylindrical portion being integrally formed on an upper end of the lower cylindrical portion in a stepped configuration, and a helical fastening portion may be formed on an inner circumference of the lower cylindrical portion, and a stopper protrusion may be formed above the helical fastening portion, and the disc portion may be formed above the stopper protrusion, and the center hole and the plurality of air holes may be formed in the disc portion, with a locking protrusion formed on an upper end of an inner circumference of the upper cylindrical portion.

The pressure opening and closing valve may be made of a silicone material by injection molding, and a skirt portion may be provided on a lower end of a cylindrical portion that has a hollow portion therein, and a protruding step may be provided on an upper end of an outer circumference of the cylindrical portion, and a pair of rectangular pieces may be integrally provided on a top of the cylindrical portion, the rectangular pieces coming into contact with each other to keep an upper end of the hollow portion closed, and, if pressure is exerted through the hollow portion, the rectangular pieces may move away from each other.

The inner cap member may include a body having a truncated cone shape, and a cylindrical portion may be integrally formed on an upper end of the body in such a way as to extend upwards therefrom, and an enlarged groove may be defined in the body, and a discharge passage may extend from an upper end of the enlarged groove in such a way as to pass through the cylindrical portion, and a pocket may be formed in an upper portion of the body in such a way as to accommodate a brush therein and to be around a lower end of the cylindrical portion, and the cylindrical portion may be disposed in the brush, with the discharge passage defined in the cylindrical portion.

The outer cap member may include a cylindrical portion, with an elliptical hollow portion formed in the cylindrical portion, and an extended inclined portion may be integrally formed on a lower end of the cylindrical portion, and an enlarged cylindrical portion may be provided on a lower end of the extended inclined portion, and an enlarged inclined hole may be formed in a lower end of the hollow portion corresponding to the extended inclined portion in such a way as to extend downwards therefrom, and an inner inclined surface may be formed around the enlarged inclined hole, and a plurality of external-air introduction grooves may be formed on the extended inclined portion and an outer circumference of the enlarged cylindrical portion.

BRIEF DESCRIPTION OF THE DRAWINGS

Various embodiments are herein described, by way of example only, with reference to the accompanying drawings, wherein:

FIGS. 9 and 10 illustrate the use of the nail polish bottle according to one embodiment of the present invention, in which FIG. 9 shows a state in which a bottle body is pushed with the nail polish bottle turned upside down to get a manicure, and FIG. 10 shows a state in which the pushed bottle body is released.

DETAILED DESCRIPTION OF THE INVENTION

Figure 1:
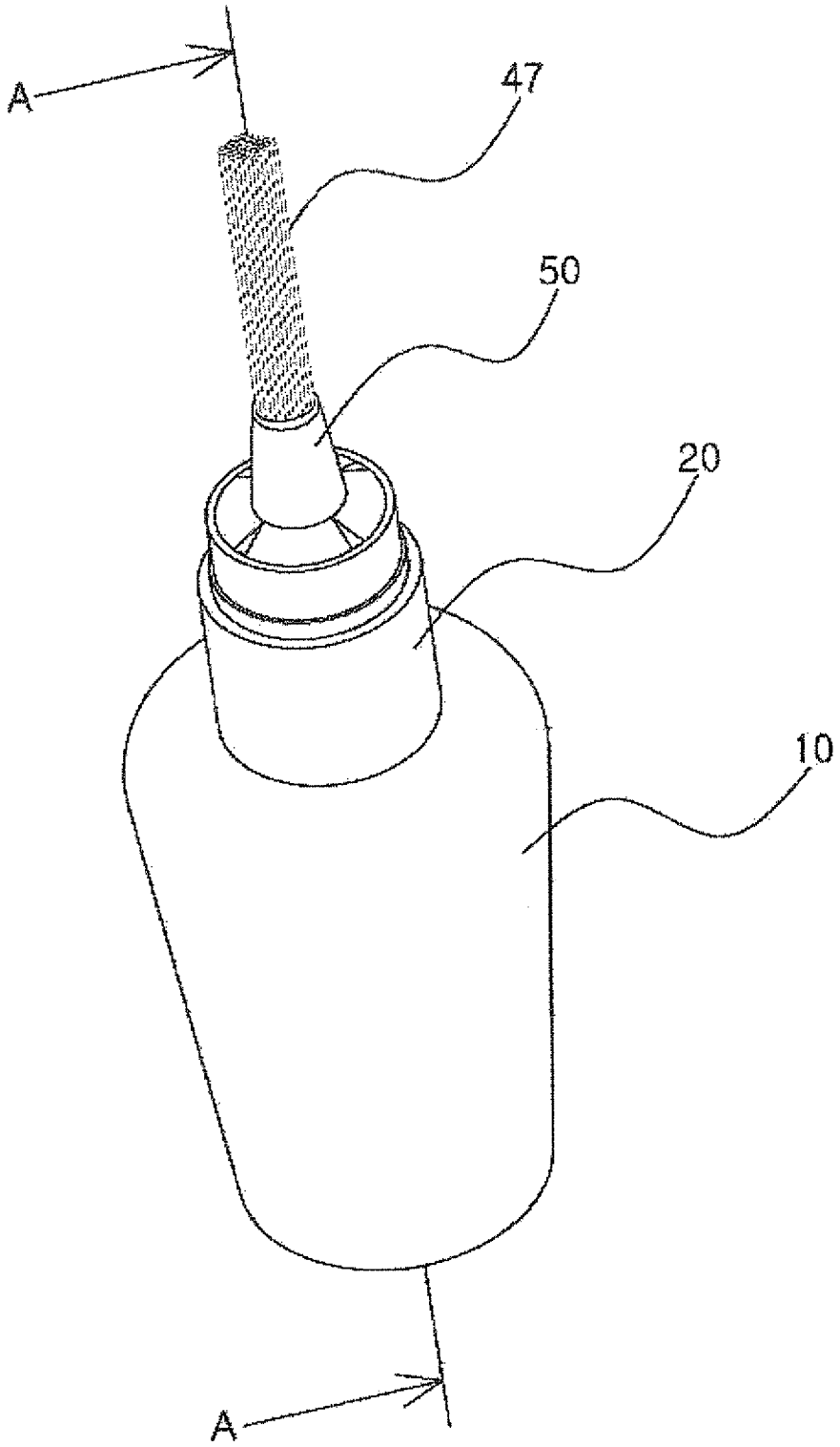
FIG. 1 is a perspective view showing a nail polish bottle according to one embodiment of the present invention in an assembled state.
Figure 2:
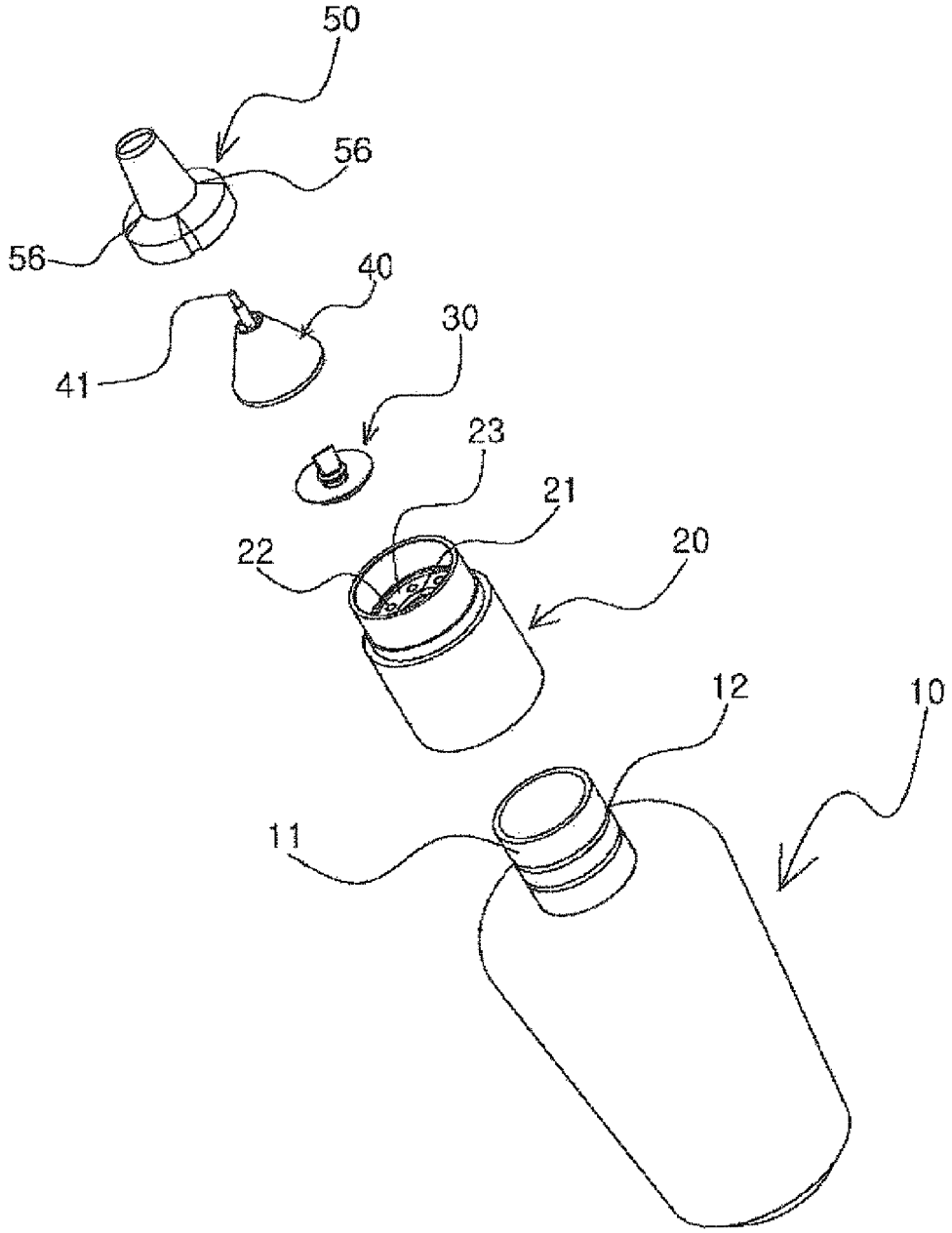
FIG. 2 is an exploded perspective view showing the nail polish bottle according to one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Referring to FIGS. 1 to 4, a nail polish bottle according to the present invention includes a bottle body 10. A cylindrical cap 20 is fastened to a bottleneck portion 11 of the bottle body 10, and includes a disc portion 23 in the cap 20, with a center hole 21 and a plurality of air holes 22 formed in the disc portion 23. A pressure opening and closing valve 30 is mounted to the disc portion 23, and serves to open or close the center hole 21 and the air hole 22 of the disc portion 23. An inner cap member 40 is mounted to the cap 20, with a discharge passage 41 and an enlarged groove 42 formed in the inner cap member 40. An outer cap member 50 is mounted to the cap 20, with a plurality of external-air introduction grooves 56 formed on the outer cap member 50. Thereby, the inner cap member 40 is covered by the outer cap member 50 that comes into contact with an inner circumference of an upper end of the cap 20, and the enlarged groove 42 of the inner cap member 40 coupled to the discharge passage 41 is disposed above the center hole 21 of the disc portion 23.

The bottle body 10 is made of a flexible nylon material by injection molding, and a side portion of the bottle body 10 is compressed by external force and then is restored to its original state, with a helical fastening portion 12 formed on the bottleneck portion 11.

Figure 5:
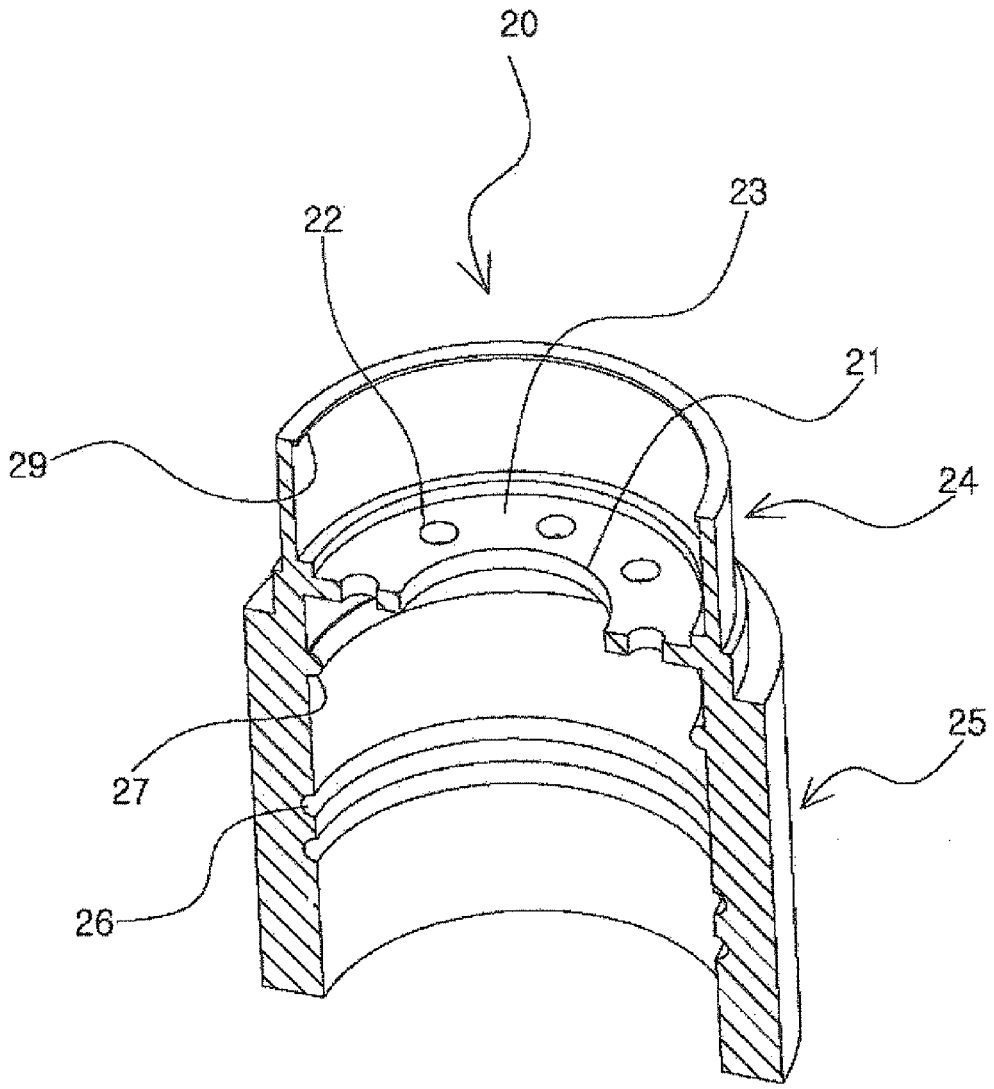
FIG. 5 is a partial sectional perspective view showing a cap in accordance with one embodiment of the present invention.

Referring to FIG. 5, the cap 20 includes an upper cylindrical portion 24 and a lower cylindrical portion 25, with the upper cylindrical portion 24 being integrally formed on an upper end of the lower cylindrical portion 25 in a stepped configuration. A helical fastening portion 26 is formed on an inner circumference of the lower cylindrical portion 25. A stopper protrusion 27 is formed above the helical fastening portion 26. The disc portion 23 is formed above the stopper protrusion 27, and the center hole 21 and the plurality of air holes 22 are formed in the disc portion 23, with a locking protrusion 29 formed on an upper end of an inner circumference of the upper cylindrical portion 24.

Figure 3:
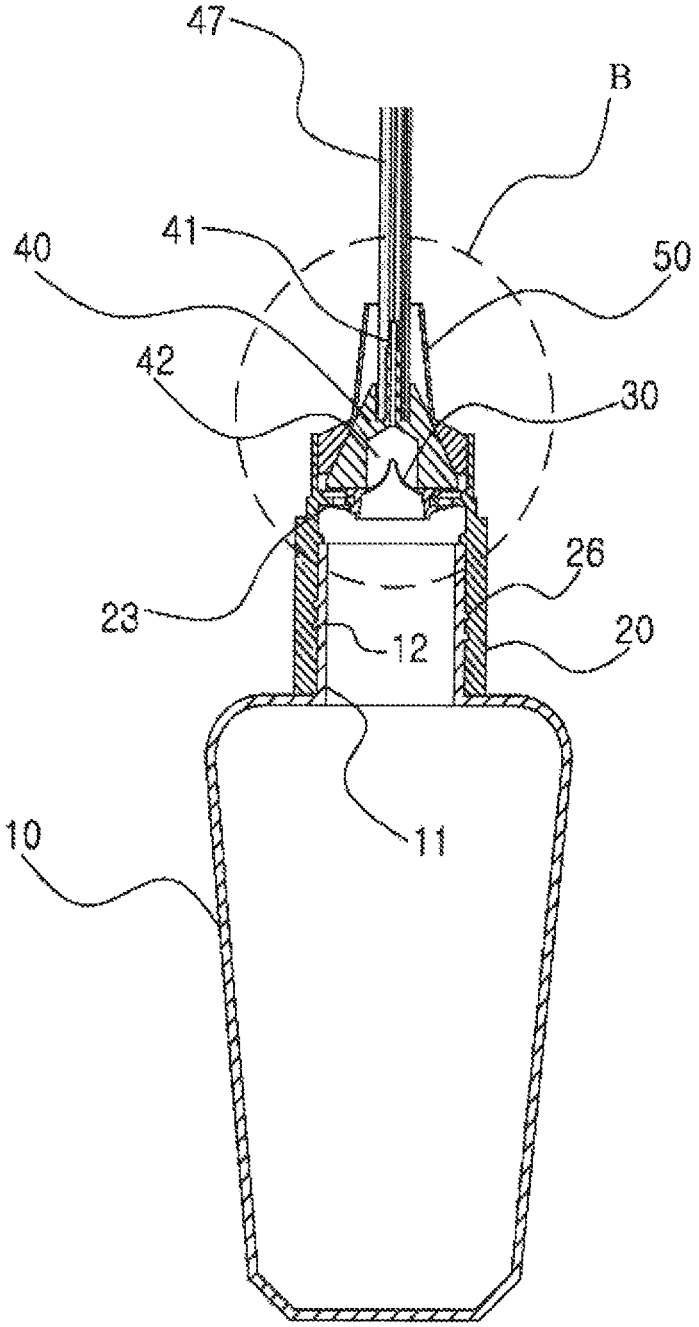
FIG. 3 is a sectional taken along line A-A of FIG. 1 showing the nail polish bottle according to one embodiment of the present invention.
Figure 4:
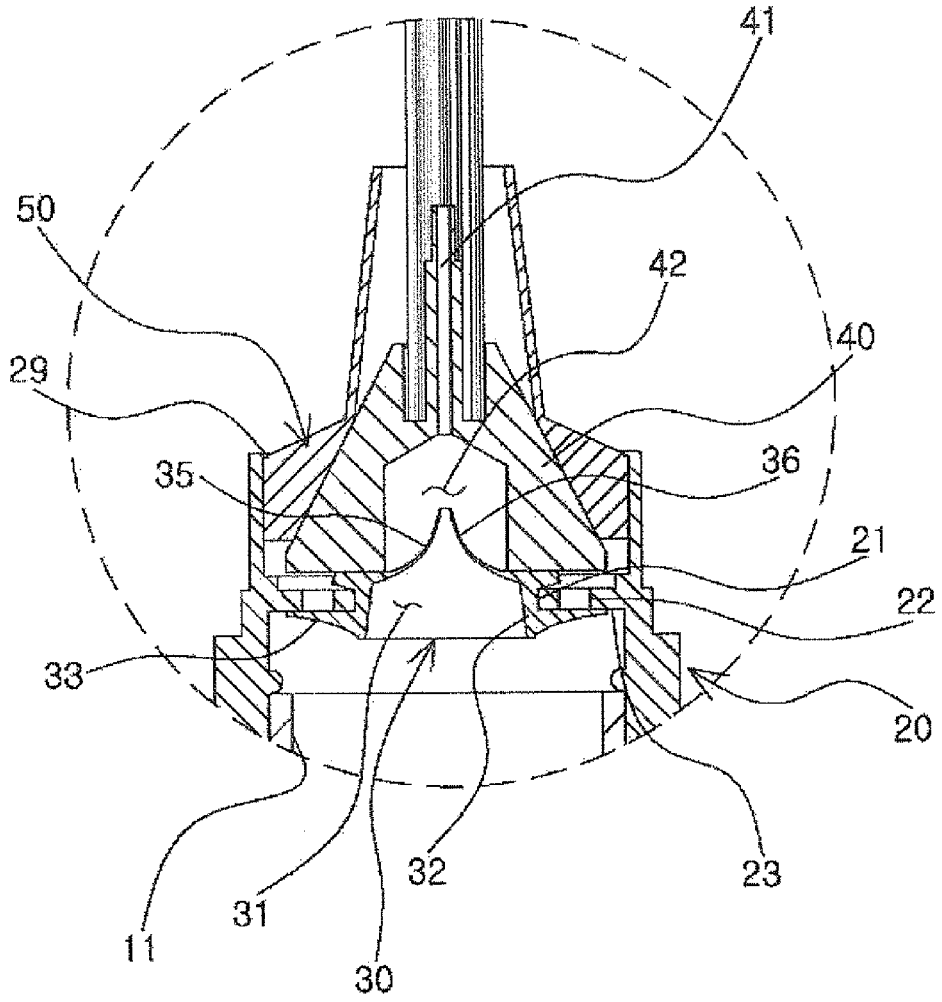
FIG. 4 is an enlarged view showing portion B of FIG. 3 in detail in accordance with one embodiment of the present invention.

Thus, as shown in FIGS. 3 and 4, when the helical fastening portion 26 of the cap 20 is fastened to the helical fastening portion 12 formed on the bottleneck portion 11 of the bottle body 10, the upper end of the bottleneck portion 11 is stopped by the stopper protrusion 27, thus preventing the cap 20 from being excessively fastened to the bottleneck portion 11 of the bottle body 10. The nail polish liquid contained in the bottle body 10 is discharged through the center hole 21 that is formed in the disc portion 23 of the cap 20, and external air is introduced into the bottle body 10 through the air holes 22 of the cylindrical portion 23.

Figure 6:
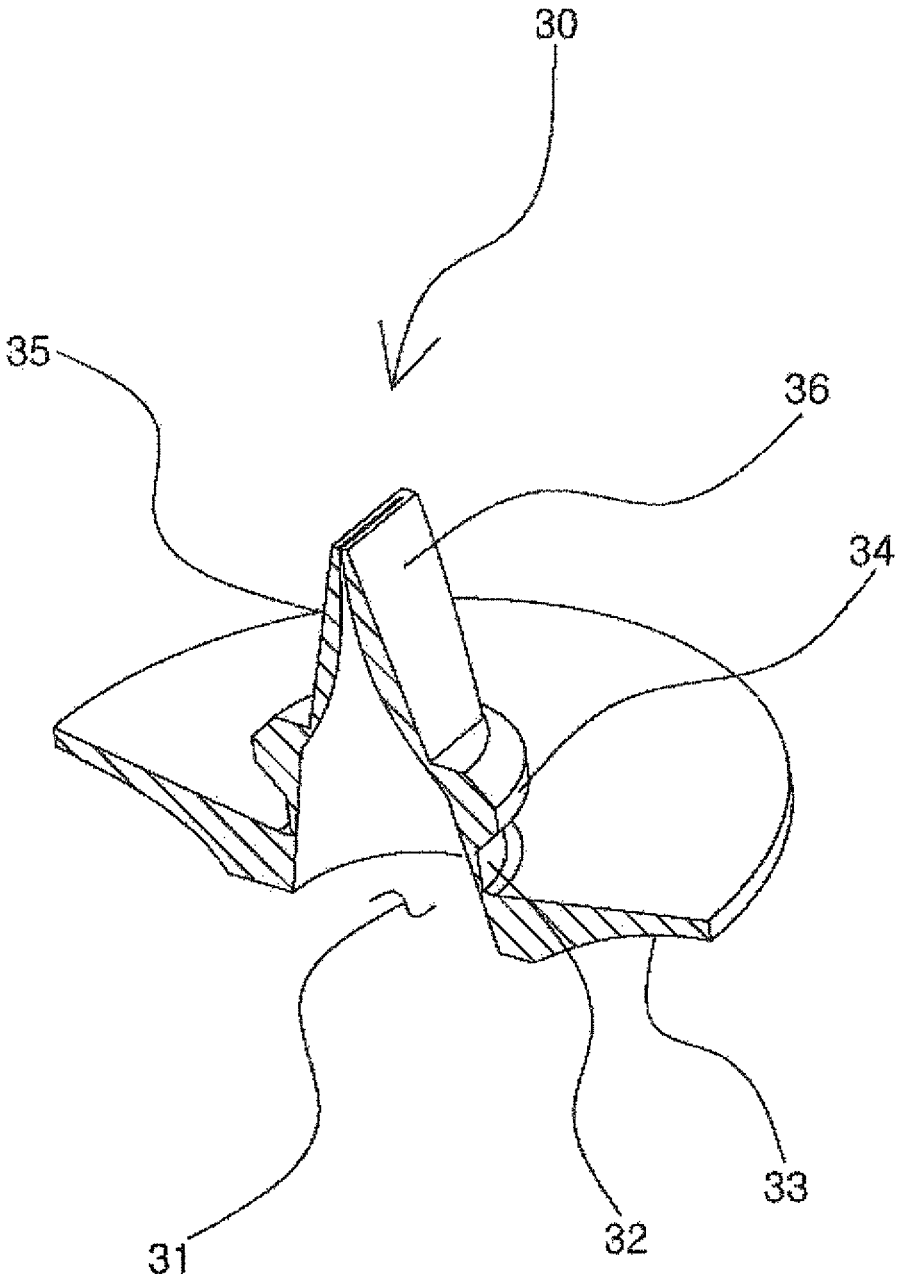
FIG. 6 is a partial sectional perspective view showing a pressure opening and closing valve in accordance with one embodiment of the present invention.

Referring to FIG. 6, the pressure opening and closing valve 30 is made of a silicone material by injection molding. A skirt portion 33 is provided on a lower end of a cylindrical portion 32 in which a hollow portion 31 is formed. A protruding step 34 is provided on an upper end of an outer circumference of the cylindrical portion 32, and a pair of rectangular pieces 35 and 36 is integrally provided on a top of the cylindrical portion 32. The rectangular pieces 35 and 36 come into contact with each other to keep an upper end of the hollow portion 31 closed. If pressure is exerted through the hollow portion 31, the rectangular pieces 35 and 36 move away from each other.

Hence, as shown in FIG. 4, the cylindrical portion 32 of the pressure opening and closing valve 30 is placed around the center hole 21 of the disc portion 23 formed in the cap 20, so that the skirt portion 33 covers a lower surface of the disc portion 23. The protruding step 34 is stopped by an upper surface of the disc portion 23, so that the cylindrical portion 32 of the pressure opening and closing valve 30 is mounted around the center hole 21 of the disc portion 23, and the skirt portion 33 blocks the air holes 22 formed in the disc portion 23, from the lower surface of the disc portion 23, thus preventing the nail polish liquid in the bottle body 10 from being introduced into the air holes 22. In contrast, if the internal pressure of the bottle body 10 is reduced, the skirt portion 33 moves away from the lower surface of the disc portion 23, so that the air hole 22 is opened.

Figure 7:
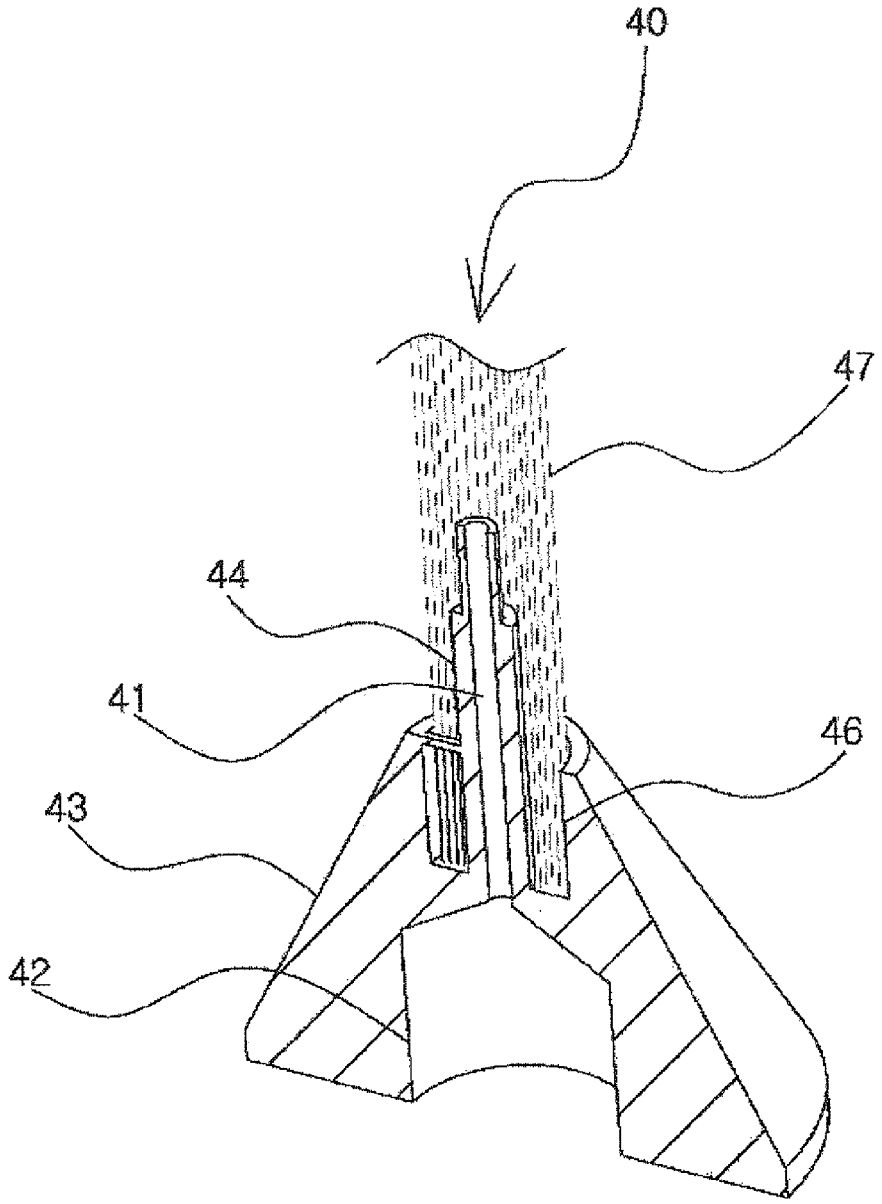
FIG. 7 is a partial sectional perspective view showing an inner cap member in accordance with one embodiment of the present invention.

Referring to FIG. 7, the inner cap member 40 includes a body 43 having a truncated cone shape. A cylindrical portion 44 is integrally formed on an upper end of the body 43 in such a way as to extend upwards therefrom. An enlarged groove 42 is defined in the body 43. A discharge passage 41 extends from an upper end of the enlarged groove 42 in such a way as to pass through the cylindrical portion 44. A pocket 46 is formed in an upper portion of the body 43 in such a way as to accommodate a brush 47 therein and to be around a lower end of the cylindrical portion 44. The cylindrical portion 44 is disposed in the brush 47, with the discharge passage 41 defined in the cylindrical portion 44.

Figure 8:
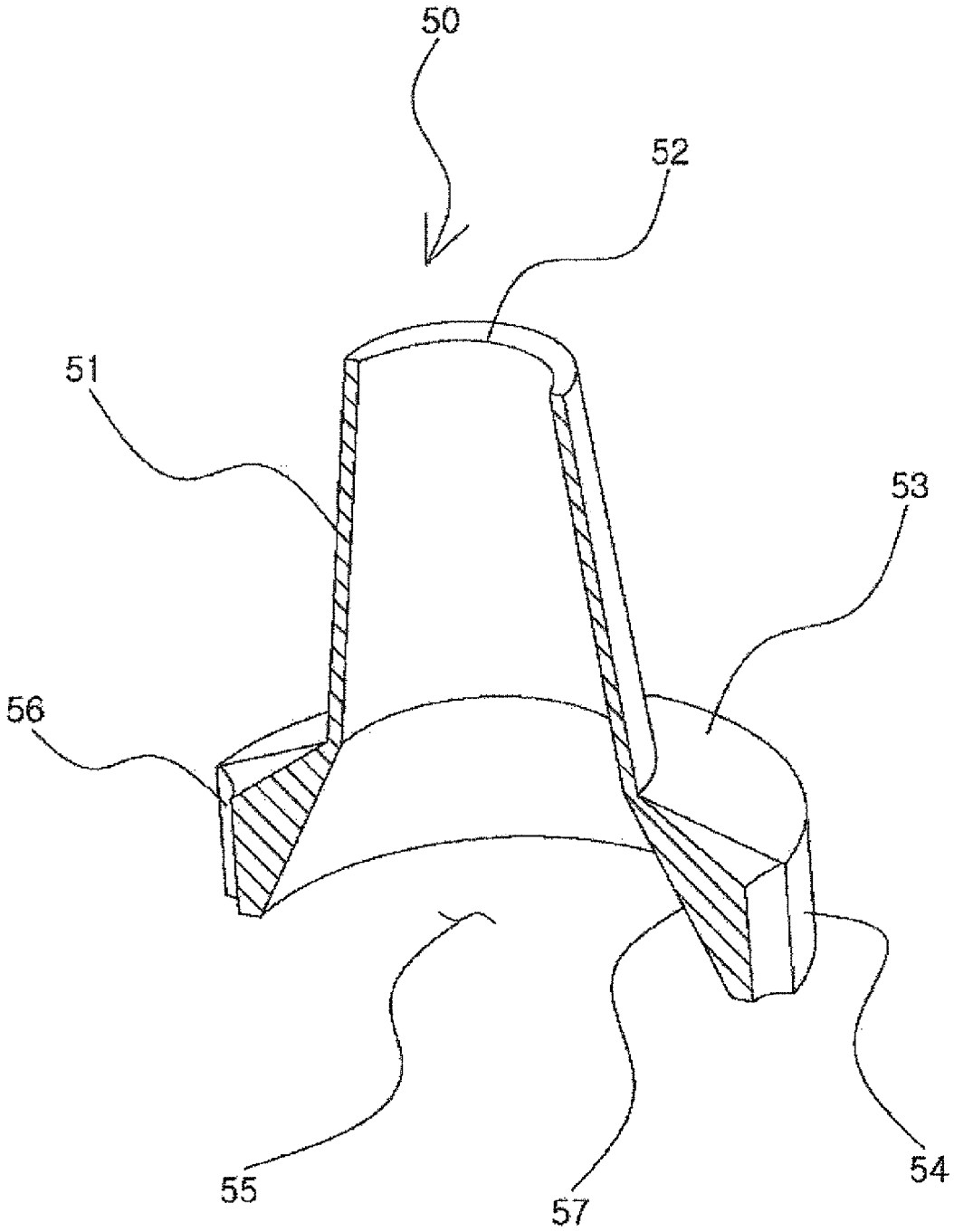
FIG. 8 is a partial sectional perspective view showing an outer cap member in accordance with one embodiment of the present invention.

Referring to FIG. 8, the outer cap member 50 includes a cylindrical portion 51, with an elliptical hollow portion 52 formed in the cylindrical portion 51. An extended inclined portion 53 is integrally formed on a lower end of the cylindrical portion 51. An enlarged cylindrical portion 54 is provided on a lower end of the extended inclined portion 53. An enlarged inclined hole 55 is formed in a lower end of the hollow portion 52 corresponding to the extended inclined portion 53 in such a way as to extend downwards therefrom. An inner inclined surface 57 is formed around the enlarged inclined hole 55. A plurality of external-air introduction grooves 56 is formed on the extended inclined portion 53 and an outer circumference of the enlarged cylindrical portion 54.

Thereby, as shown in FIG. 4, the circumference of the upper end of the extended inclined portion 53 of the outer cap member 50 is locked by the locking protrusion 29 of the cap 20 so as to prevent unexpected removal. The body 43 of the inner cap member 40 is fitted into the enlarged inclined hole 55 of the outer cap member 50, so that the body 43 of the inner cap member 40 comes into close contact with the inner inclined surface 57 of the outer cap member 50, and thereby the brush 47 of the inner cap member 40 is exposed to the outside through the hollow portion 52 of the outer cap member 50.

An operation of the nail polish bottle according to the present invention configured as described above will be described in detail with reference to FIGS. 9 and 10.

Figure 9:
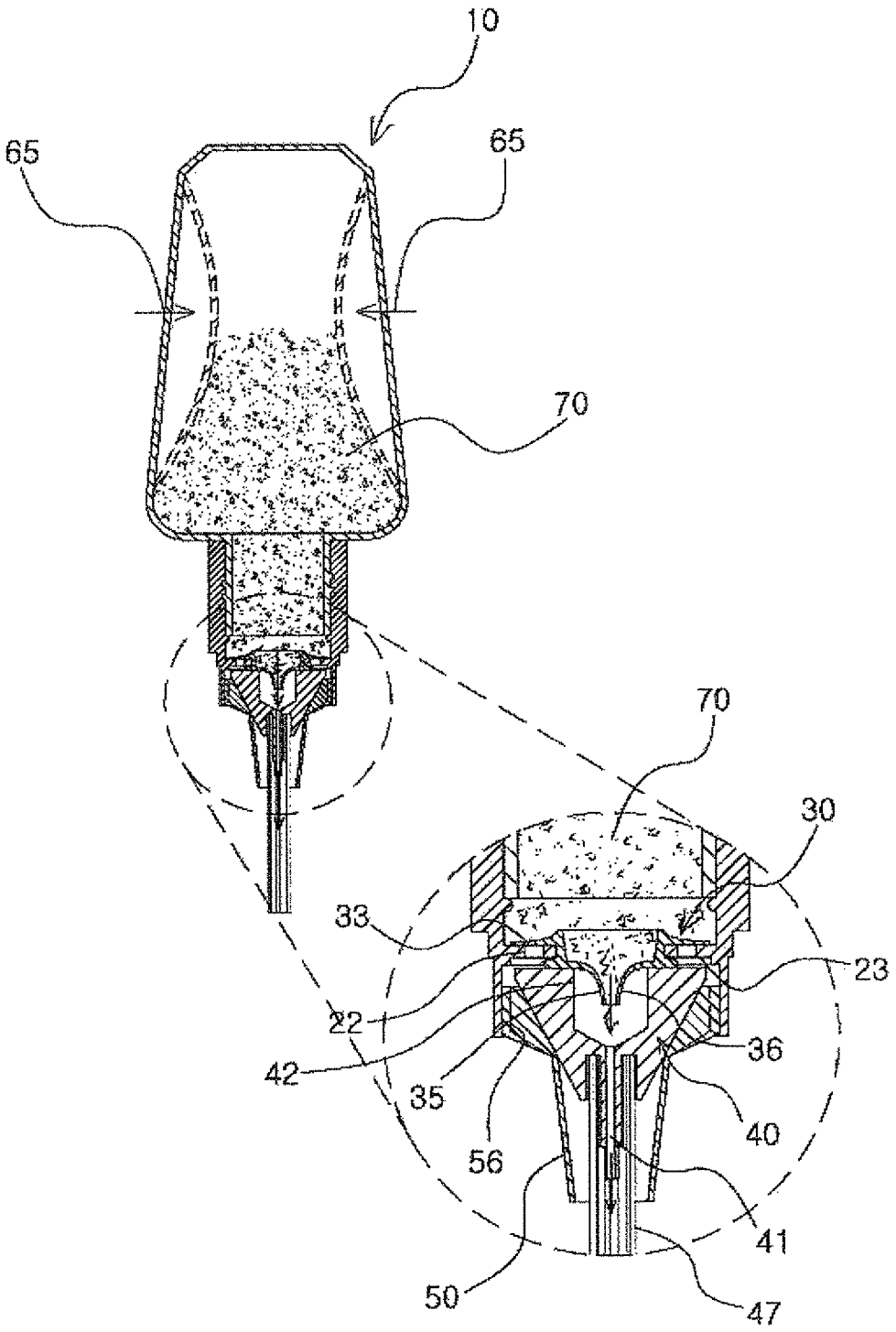

First, as shown in FIG. 9, if the bottle body 10 is pushed in a direction of arrow 65 in a state in which the nail polish bottle is turned upside down for the purpose of a manicure, the rectangular pieces 35 and 36 of the pressure opening and closing valve 30 are moved away from each other by pressure. Simultaneously, the nail polish liquid 70 contained in the bottle body 10 is discharged through a gap between the rectangular pieces 35 and 36 of the pressure opening and closing valve 30, the enlarged groove 42 and the discharge passage 41 of the inner cap member 40. The nail polish liquid discharged from the discharge passage 41 of the inner cap member 40 permeates the brush 47, thus allowing a user to apply the nail polish liquid.

In this regard, the skirt portion 33 of the pressure opening and closing valve 30 blocks the air holes 22 formed in the disc portion 23, from the lower surface of the disc portion 23, so that the nail polish liquid of the bottle body 10 is not introduced into the air holes 22, thus preventing the nail polish liquid from leaking to the outside through the external-air introduction grooves 56 of the outer cap member 50.

Figure 10:
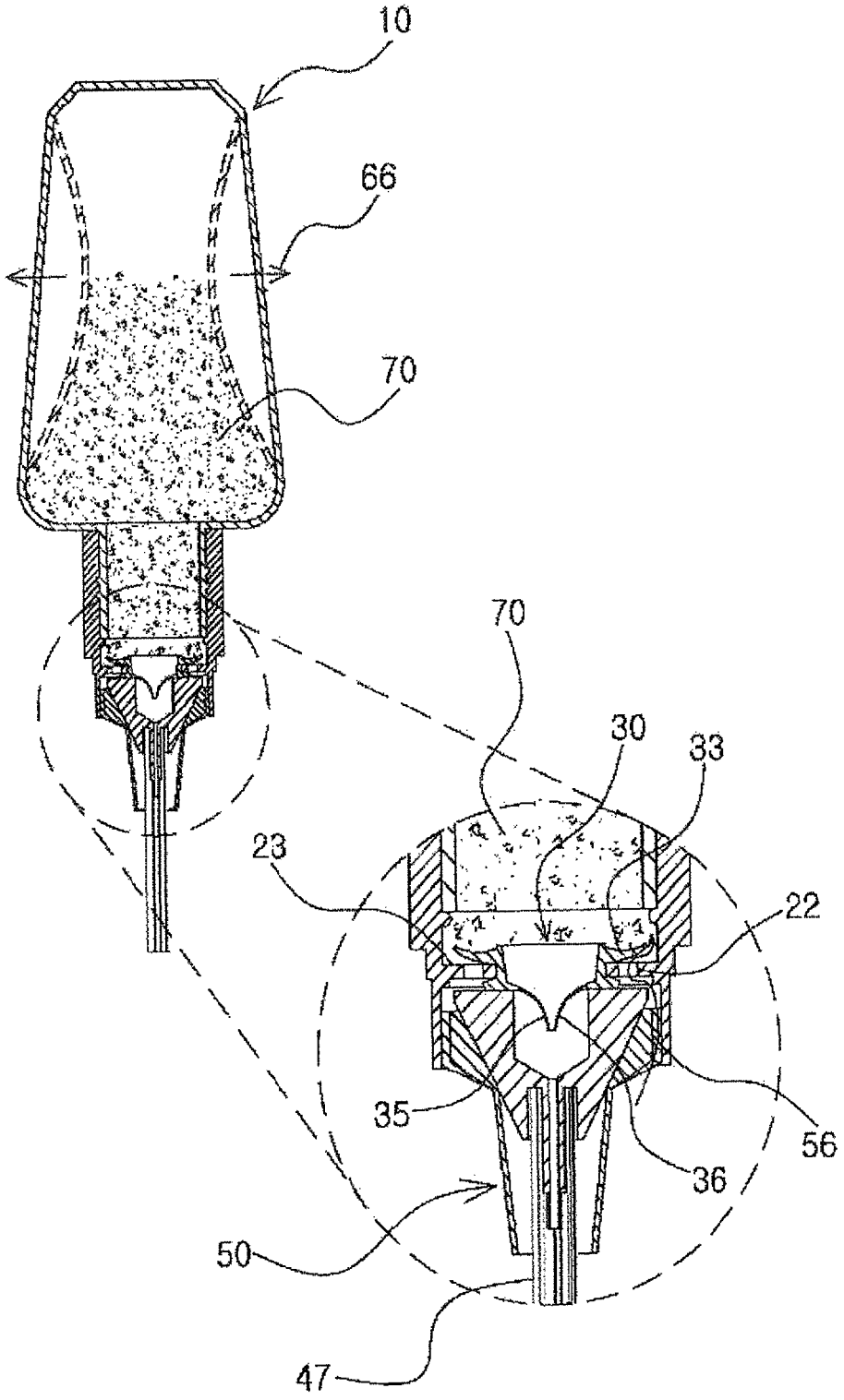

Further, as shown in FIG. 10, if a pushing force is removed from the bottle body 10 after a user finishes using the nail polish, the bottle body 10 is restored to its original state in the direction of arrow 66, and the rectangular pieces 35 and 36 of the pressure opening and closing valve 30 are closed by their own elastic force (restoring force), thus preventing the nail polish liquid in the bottle body 10 from leaking to the brush 47.

As such, according to the present invention, even if the bottle body 10 is laid down or turned upside down, the rectangular pieces 35 and 36 of the pressure opening and closing valve 30 are closed, thus preventing the nail polish liquid 70 from unexpectedly leaking from the bottle body 10.

Further, if the pushing force is eliminated from the bottle body 10, the bottle body 10 is restored to its original state by its own elasticity. Here, the skirt portion 33 of the pressure opening and closing valve 30 moves away from the lower surface of the disc portion 23, so that the air holes 22 of the disc portion 23 are opened, and thereby air introduced through the external-air introduction grooves 56 of the outer cap member 50 is fed through the air holes 22 of the disc portion 23 into the bottle body 10.

As described above, the present invention provides a nail polish bottle, which is configured so that, if a bottle body is pushed, the internal pressure of the bottle body is increased and thus the pressure opening and closing valve is opened, thereby discharging nail polish liquid contained in the bottle body through a discharge passage to a brush and allowing a user to apply to polish to his or her nails, and, if force is eliminated from the bottle body, the internal pressure of the bottle body is restored to its original state and thus the pressure opening and closing valve is closed, thereby automatically preventing the nail polish liquid from leaking.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A nail polish bottle, comprising:

a bottle body;

a cylindrical cap fastened to the bottle body, and including a disc portion in the cap, with a center hole and a plurality of air holes formed in the disc portion;

a pressure opening and closing valve mounted to the disc portion, a top of the valve above the center hole opening or closing depending on internal pressure of the bottle body, the valve also opening or closing the air holes of the disc portion depending on internal pressure of the bottle body;

an inner cap member mounted to the cap, with a discharge passage disposed above the center hole;

an outer cap member mounted to the cap, with at least one external-air introduction groove that is formed on the outer cap member and that is in flow contact with at least one air hole of the disc portion, wherein an enlarged groove is formed in the inner cap member and wherein the inner cap member is covered by the outer cap member, the outer cap member coming into contact with an inner circumference of an upper end of the cap.

2. The nail polish bottle of claim 1, wherein the cap comprises an upper cylindrical portion and a lower cylindrical portion, the upper cylindrical portion integrally formed on an upper end of the lower cylindrical portion in a stepped configuration and wherein a helical fastening portion is formed on an inner circumference of the lower cylindrical portion, a stopper protrusion is formed above the helical fastening portion, and the disc portion is formed above the stopper protrusion.

3. The nail polish bottle of claim 2, wherein a locking protrusion is formed on an upper end of an inner circumference of the upper cylindrical portion.

4. A nail polish bottle, comprising:

a bottle body;

a cylindrical cap fastened to the bottle body, and including a disc portion in the cap, with a center hole and a plurality of air holes formed in the disc portion;

a pressure opening and closing valve mounted to the disc portion, a top of the valve above the center hole opening or closing depending on internal pressure of the bottle body, the valve also opening or closing the air holes of the disc portion depending on internal pressure of the bottle body;

an inner cap member mounted to the cap, with a discharge passage disposed above the center hole;

an outer cap member mounted to the cap, with at least one external-air introduction groove that is formed on the outer cap member and that is in flow contact with at least one air hole of the disc portion, wherein the inner cap member comprises a body having a truncated cone shape, and a cylindrical portion is integrally formed on an upper end of the body in such a way as to extend upwards therefrom, and an enlarged groove is defined in the body, and a discharge passage extends from an upper end of the enlarged groove in such a way as to pass through the cylindrical portion, and a pocket is formed in an upper portion of the body, the pocket adapted to accommodate a brush therein, and the cylindrical portion adapted to be disposed in the brush, with the discharge passage defined in the cylindrical portion.

5. The nail polish bottle of claim 1, wherein the outer cap member comprises a cylindrical portion, with an elliptical hollow portion formed in the cylindrical portion, and an extended inclined portion is integrally formed on a lower end of the cylindrical portion, and an enlarged cylindrical portion is provided on a lower end of the extended inclined portion, and an enlarged inclined hole is formed in a lower end of the hollow portion corresponding to the extended inclined portion in such a way as to extend downwards therefrom, and an inner inclined surface is formed around the enlarged inclined hole, and a plurality of external-air introduction grooves is formed on the extended inclined portion and an outer circumference of the enlarged cylindrical portion.

* * * * *